US006226486B1

(12) United States Patent
Itou et al.

(10) Patent No.: US 6,226,486 B1
(45) Date of Patent: May 1, 2001

(54) IMAGE FORMING APPARATUS WITH ELECTRICALLY GROUNDED ROLLER

(75) Inventors: Yoshikuni Itou, Yokohama; Masahiro Inoue, Mishima; Yoichi Kimura, Numazu; Yuji Bessho, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/088,699

(22) Filed: Jun. 2, 1998

(30) Foreign Application Priority Data

Jun. 4, 1997 (JP) ..... 9-161811
Jul. 4, 1997 (JP) ..... 9-194847

(51) Int. Cl.[7] ..... G03G 15/00; G03G 15/01; B41J 2/385

(52) U.S. Cl. ..... 399/303; 347/139; 399/44; 399/45; 399/315

(58) Field of Search ..... 347/140, 139, 347/262, 264; 399/44, 45, 303, 312, 313, 299, 298, 314, 315

(56) References Cited

U.S. PATENT DOCUMENTS

| | | | | |
|---|---|---|---|---|
| 5,017,969 | * | 5/1991 | Mitomi et al. | 399/299 |
| 5,187,536 | | 2/1993 | Hasegawa et al. | 399/300 |
| 5,469,248 | * | 11/1995 | Fujiwara et al. | 399/298 X |
| 5,550,620 | | 8/1996 | Kimura et al. | 399/304 |
| 5,552,871 | * | 9/1996 | Kutsuwada et al. | 399/313 |
| 5,594,538 | | 1/1997 | Takekoshi et al. | 399/310 |
| 5,600,421 | | 2/1997 | Takeoshi et al. | 399/66 |
| 5,659,843 | * | 8/1997 | Takano et al. | 399/314 X |
| 5,724,633 | * | 3/1998 | Amemiya | 399/299 X |
| 5,794,110 | * | 8/1998 | Kasai et al. | 399/303 X |

FOREIGN PATENT DOCUMENTS

| | | |
|---|---|---|
| 0 713 158 | 5/1996 | (EP) . |
| 1-276159 | 11/1989 | (JP) . |
| 3-069977 | 3/1991 | (JP) . |
| 3-231274 | 10/1991 | (JP) . |
| 6-258957 | 9/1994 | (JP) . |
| 7-302002 | 11/1995 | (JP) . |
| 8-339127 | 12/1996 | (JP) . |
| 9-106191 | 4/1997 | (JP) . |

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an image bearing member for carrying a toner image; a recording material conveyer belt for electrostatically carrying and feeding a recording material; a roller, provided on a side of the recording material conveyer belt not carrying the recording material in a separation position where the recording material is separated from the recording material conveyer belt, for supporting the recording material conveyer belt; a transfer charger for electrostatically transferring the toner image from the image bearing member onto the recording material at a transfer position; a discharge, provided across the recording material conveyer belt from the roller at the separation position, for discharging the recording material upon separation thereof from the recording material conveyer belt; wherein the roller is electrically grounded through an element in which a voltage is generated when the current is supplied thereto.

85 Claims, 6 Drawing Sheets

IMAGE FORMING APPARATUS WITH ELECTRICALLY GROUNDED ROLLER

FIELD OF THE INVENTION AND RELATED ART

The present invention relates to an image forming apparatus wherein an image is transferred onto a recording material carried on a recording material carrying member.

Heretofore, various image forming apparatuses having a plurality of image forming stations have been proposed in which different color toner images are formed by the image forming stations, and the images are transferred superimposedly onto the same recording material (reporting paper), thus forming a color image.

In one of such apparatuses, a color copying machine of a multi-color electrophotographic type using an endless recording material carrying member is known as a high-speed image forming apparatus.

Referring first to FIG. 2, an example of color electrophotographic image forming apparatus will be described. In the apparatus, there are provided first, second, third and fourth image forming stations Pa, Pb, Pc and Pd, by which different color toner images are formed through latent image formation, development and image transfer processes.

Each of said image forming stations is provided with an image bearing member 3*a*, 3*b*, 3*c* or 3*d*, and each color image is formed on the image bearing member which is in the form of an electrophotographic photosensitive drum.

Adjacent to each of the photosensitive drum, a recording material carrying member in the form of a transfer belt of dielectric material 130 is disposed, and the toner image formed on the photosensitive drum is transferred onto the recording material p carried on the transfer belt 130. The recording material p now having the transferred image is subjected to operation of a separation charger 32 (corona charged) by which the attraction force to the transfer belt 130 is reduced, and it is separated from the transfer belt 130. Thereafter, the recording material p is fed to a fixing station 9, where the toner image is fixed by heat and pressure on the recording material, which is then discharged onto an outside tray 63 as a copy or print.

However, this structure involves a problem, when, for example, a recording material having a low resistance resulting by keeping the recording material in a high humidity condition. More particularly, when the recording material may function as a short-circuit between the transfer position and the grounded electroconductive driving roller (separating means) 13 functioning as an opposing electrode, the toner image is not transferred in good order onto the recording material, or the toner image once transferred onto the recording material is transferred back onto the drum at a downstream portion of image forming station (retransfer), with the result of remarkably improper image transfer or formation. Generally, the volume resistivity of the recording material ranges between approximately $10^7$ to $10^{11}$ Ohm·cm depending on the material of the recording material or the water content thereof.

This phenomenon will be described in more detail, referring to FIG. 5. During image formation, the recording material short-circuits between the driving roller 13 and the photosensitive drum in the fourth image forming station. Then, back side positive charge of a part of charge couple at a portion of the transfer belt 130 which are in contact both with the recording material and the driving roller 13 (the hatched portion E in FIG. 5) flows to the driving roller 13, and surface negative charge thereof flows into the transfer charging portion through the recording material. As a result, electric discharge occurs. At this time, the transfer current which is to flow from the transfer charger 24*d* to the photosensitive drum 3*d* (opposite electrode), indicated by the arrows A and B FIG. 5, flows to the transfer belt E, as indicated by arrows A and D, with the result that transfer current is not enough.

When the recording material short-circuits between the photosensitive drum 3*d* of the fourth image forming station and the driving roller 13, the portion of the transfer belt 130 tends to supply the positive charge from the photosensitive drum 3*d* as well as taking all of the transfer current, the resistance of recording material further reduces. As a result, the current flows in the directions A and D and C and D.

Moreover, when the separation discharger 32 is operated in order to separate the recording material and the transfer belt 130 simultaneously with image transfer, the negative charge is supplied from the separation discharged 32 to the photosensitive drum 3*d* through the recording material with the result of improper image transfer.

The direction C is opposite from the direction B which is the direction of proper image formation. By the opposite current, the toner is not properly transferred, or the toner retransfers to the photosensitive drum 3*d*.

SUMMARY OF THE INVENTION

Accordingly, it is a principal object of the present invention to provide an image forming apparatus capable of preventing improper image transfer from an image bearing member to the recording material carried on a recording material carrying belt.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
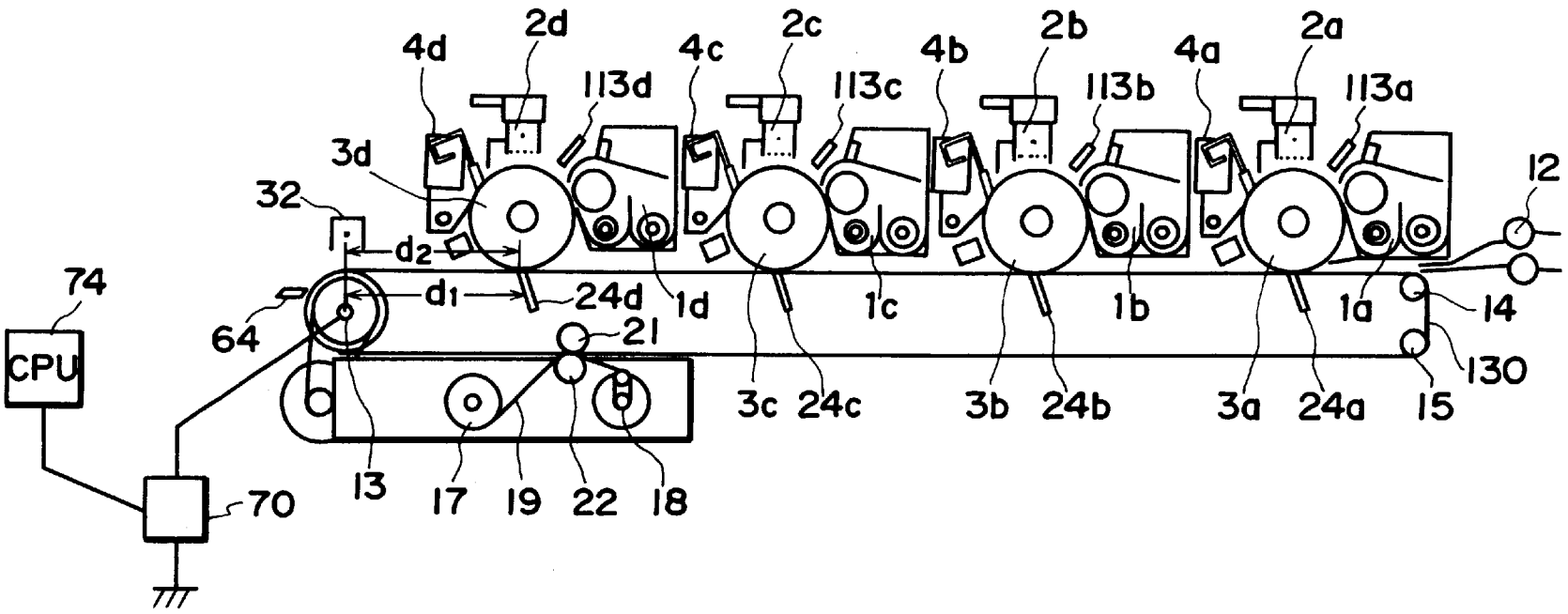
FIG. 1 is a schematic view of an image forming apparatus according to Embodiment 1 and Embodiment 2.

The image forming apparatuses according to the embodiments of the present invention will be described in conjunction with the accompanying drawings. In the following description, the image forming apparatus is in the form of a full color image forming apparatus shown in FIG. 2 having been described in the foregoing.

Around the photosensitive drums 3*a*, 3*b*, 3*c* and 3*d*, there are provided exposure lamps 111*a*, 111*b*, 111*c* and 111*d*, drum chargers 2*a*, 2*b*, 2*c* and 2*d*, potential sensors 113*a*, 113*b*, 113*c* and 113*d*, developing devices 1*a*, 1*b*, 1*c* and 1*d*, transfer chargers 24*a*, 24*b*, 24*c* and 24*d*, and cleaners 4*a*, 4*b*, 4*c* and 4*d*, respectively. In an upper portion of the apparatus, there are provided unshown light sources and polygonal mirrors.

A laser beam emitted by the light source is scanningly deflected by a polygonal mirror 117, and the beam is deflected by a reflection mirror and is directed through a f-theta lens to the photosensitive drum 2*a* to 2*d* to scan it in the direction of the generating line of the drum, so that latent image is formed on the photosensitive drum 3*a* to 3*d* in accordance with image signals.

The developing means 1*a* to 1*d* contain predetermined amount of cyan, magenta, yellow and black toner particles having negative charging property, respectively, supplied by unshown supplying means. The developing means 1*a* to 1*d* develop the latent images on the photosensitive drums 3*a* to 3*d* to visualize them into cyan toner image, magenta toner image, yellow toner image and black toner image through reverse development.

The recording material p is contained in a recording material cassette 10, and is supplied to the transfer belt 130 by a plurality of feeding rollers 11 and registration rollers 12, and the recording materials are sequentially fed to the transfer station where the recording material is faced to the photosensitive drum 3*a*.

The transfer belt 130 is of dielectric material sheet such as polyethylene terephthalate resin sheet (PET), polyvinyriden-fluoride resin sheet, polyurethane resin sheet. The opposite ends thereof are overlaid and bonded together with each other into a form of an endless film, or it may be a seamless and endless film of such a dielectric material.

The electroconductive driving roller 13 and supporting rollers 14 and 15 rotate the transfer belt 130, and when it is detected that transfer belt 130 is at a predicament position, the recording material p is fed to the transfer belt 130 from the registration rollers 12, and is carried to the transfer station of the first image forming station Pa. Simultaneously therewith, the image writing signal is turned on, and the image forming operation on the photosensitive drum 3*a* is started at a predetermined timing on the basis of the writing signal in the first image forming station Pa.

Attraction chargers 5 and 6 are provided between the supporting roller 14 and the transfer charger 24*a* of the first image forming station Pa such that transfer belt 130 is interposed between the attraction chargers. The recording material thus fed is attracted on the transfer belt before the transfer operation. The transfer charger 24*a* applies the electric field or charged at the transfer position (nip formed between the transfer belt 130 and the photosensitive drum 3*a*, by which the toner image of the first color is transferred onto the recording material p from the photosensitive 3*a*. The attraction chargers 5 and 6 may be omitted, and the recording material p may be electrostatically attracted on the transfer belt 130 firmly. The recording material p is fed then to the second image forming station Pb and subsequent image forming stations. In other words, the recording material p may be electrostatically attracted on the transfer belt 130 simultaneously with the image transfer operation.

In this example, the attraction charges 5 and 6 are in the form of rollers, but they may be non-contact type chargers such as corona chargers, or may be contact type chargers using charging members such as blade or brush.

In this example, the transfer chargers 24*a* to 24*d* are in the form of a transfer blade, but they maybe non-contact type chargers such as corona chargers, or may be contact type chargers using charging members such as a blade or brush. The contact type charger is advantageous in that amount of ozone production is much less and in that influence of the humidity and temperature of the ambience is small. This embodiment uses the contact charger for each of the attraction charger and the transfer charger.

For the purpose of stability in the image transfer, discharging needles 7*a*, 7*b*, 7*c* and 7*d* may be provided downstream of the transfer chargers 24*a*, 24*b*, 24*c* and 24*d* with respect to movement direction of the transfer belt 130. The discharging needles 7*a* to 7*d* are out of contact with the transfer belt 130, but is effective to discharge a part of transfer current. With this structure, separation discharge which may occur at the transfer position upon separation of the recording material from the photosensitive drum can be prevented particularly when the humidity is low, for example.

The image forming and transfer operations at the second, third and fourth image forming stations Pb, Pc and Pc are the same as in the first image forming station. The recording material p now having the 4-color toner image is electrically discharged at a separation position downstream of to transfer position by the separation charger 32 as a discharging means so that electrostatic attraction force to the transfer belt 130 is reduced, by which the recording material is separated from the transfer belt 130. The separation charger 32 acts on the recording material p to charge or discharge the recording material p while the toner image is unfixed, and therefore, a non-contact type charger (corona charger) is used. During the separating operator, the separation charger is supplied with an AC voltage having a peak-to-peak voltage 10 kVpp and a frequency 500 Hz.

The recording material p separated from the transfer belt 130 is fed to a fixing device 9 by feeding means 62 along a guiding member.

The fixing device 9 comprises a fixing roller 51, pressing roller 52, heat resistive cleaning members 54 and 55 for cleaning the fixing and pressing rollers, roller heating heaters 56 and 57 disposed in the rollers 51 and 52, respectively, an oil application roller for applying parting oil such as dimethylsilicone oil, an oil container 53 for containing the oil, a thermister 58 for controlling the fixing temperature on the basis of a detected temperature of the surface of the pressing roller.

The recording material p having a 4-color toner image is subjected to the image fixing operator so that toner image are mixed and fixed on the recording material p, by which a full-color toner image is produced, and the recording material p is discharged onto the discharge tray 63.

The photosensitive drums 3*a* to 3*d* after the image transfer operation, is cleaned by cleaners 4*a*–4*d*, so that residual toner is removed therefrom to be prepared for the next latent image forming operation and the like. The toner and foreign matter remaining on the transfer belt 130 is wiped by a cleaning web (unwoven textile) 19. The contact of the cleaning web 19 to the transfer belt 130 is controlled by a supply roller 17, a take-up roller 18, a tension roller 22 and a backup roller 21. In addition, a predetermined current is applied between rollers 21 and 22 to electrically discharge the transfer belt 130.

The transfer belt used in such an image forming apparatus is a dielectric member sheet such as PET sheet, polyvinylidene fluoride sheet or polyurethane sheet having a volume resistivity of $10^{13}$–$10^{18}$ Ohm·cm.

The image is stabilized if the current contributable to the image transfer action of the transfer charging means is controlled to be at a proper constant level (constant current control). In this embodiment, therefore, a constant-current-control is carried out so as to provide a constant current even if the volume resistivity varies due to the kind (thickness, material or the like) of the recording material or due to the wetting condition of the paper or the like.

In such a control, the transfer voltage applied to the transfer charger 24*a*–24*d* sequentially increases in accordance with charge-up of the transfer belt 130, for example, 1 kV at the first image formation station, 2 kV at the second image formation station, 3 kV at the third image formation station, and 4 kV at the fourth image formation station. The transfer belt 130 and the recording material p are separated from each other at the separation portion after a predetermined amount of charge is given thereto through the constant-current-control in the transfer process, and the transfer belt 130 is discharged by a transfer belt discharging station where the couple of rollers 21 and 22 are provided, and the recording material is discharged by recording material discharging station (not shown) after the fixing process.

Embodiment 1

Referring to FIG. 1, an image forming apparatus according to Embodiment 1 according to the present invention will be described.

Examples of the material of the dielectric sheet of the transfer belt 130 include PET, polyacetal, polyamide, polyvinylalccohol, polyetherketone, polystyrene, polybutyleneterephthalate, polymethylpentene, polypropylene, polyethylene, polyphenylenesulfide, polyurethane, silicon resin material, polyamide-imide, polybarbonate, polyphenyleneoxide, polyethersulfon, polysulfone, aromatic polyester, polyetherimide, aromatic polyimide, or the like; engineering plastic resin material film or the like. In this embodiment, the use is made with polyimide resin material in view of the mechanical property, electrical property and incombustibility. It is a seamless type, and the volume resistivity thereof is $10^{16}$ Ohm·cm, and the thickness thereof is 10 $\mu$m.

The process speed in the image forming apparatus of the embodiment (rotational speed of the transfer belt and the photosensitive drum) is 100 mm/s.

The transfer chargers 24*a*, 24*b*, 24*c* and 24*d* are of plate-like electroconductive rubber having a rectangular shape extending in a direction(thrust direction) perpendicular to a recording material feeding direction. The plate-like electroconductive rubbers are urged toward the associated photosensitive drums 3*a*, 3*b*, 3*c*, 3*d* through the transfer belt 130. The back side of the recording material p fed to the transfer portion is charged with the polarity (positive polarity) opposite from that of the toner by the transfer chargers 24*a*–24*d*, so that toner image is electrostatically transferred from the photosensitive drums 3*a*–3*d* onto the surface of the recording material p. In this embodiment, the constant-current-control is carried out, wherein the transferring current is 6 $\mu$A.

Figure 5:
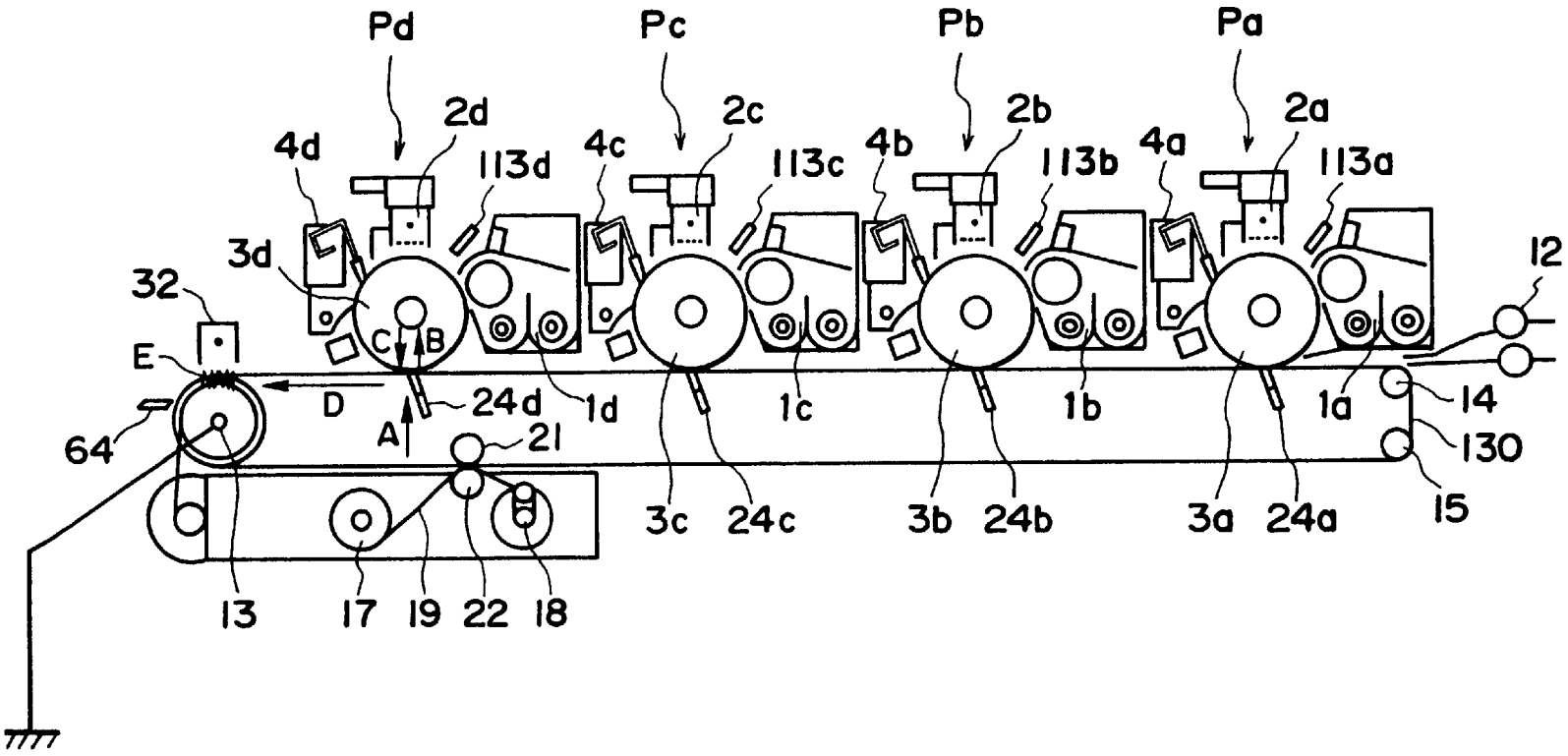
FIG. 5 PRIOR ART
FIG. 5 is a schematic view of a conventional image forming apparatus.

As shown in FIG. 5 which has been described hereinbefore, the driving roller 13 is electrically grounded to the main assembly ground, and the distance between the transfer charger 24*d* and the driving roller d1=50 mm. The electric current flowing into the driving roller 13 during the image forming operation was 3 $\mu$A under the high temperature and high humidity ambience (absolute water content (wt.(g) of watervapor in 1 kg air) was approx. 22 g/kg , the temp. and relative humidity were 30° C. and 80%). The image formed at this time was unsatisfactory due to transfer defect. However, only when the recording material p is between the fourth photosensitive drum 3*d* and the driving roller 13 or between the third photosensitive drum 3*c* and the driving roller 13, the flow of the transferring current into the driving roller 13 (A–D direction, C–D direction) and the resultant transfer defect occur. The recording material p had a length larger than the distance between a position where the transfer belt 130 is contacted to the third transfer charger 24*c* to a position where it is contacted to the driving roller 13, and it was "GINKAN" (tradename) available from Nippon Seishi KABUSHIKI KAISHA, Japan having a basis weight of 157 g/m$^2$, which was kept under the ambient condition for sufficient period. Here, it is considered that transferring current escapes from the fourth transfer charger 24*d* or the third transfer charger 24*c* to the driving roller 13, or the current flows into the driving roller 13 when the recording material p is discharged by the separation charger 32 (the negative charge flows toward the photosensitive drums 3*c*, 3*d*).

In this embodiment, the driving roller 13 is not directly connected to the main assembly ground, but, as shown in FIG. 1, the driving roller 13 is connected to the main assembly ground through a constant current source 70, and constant current source 70 effects the constant-current-control to prevent the current between the driving roller 13 and the transfer charger 24*d* or between the driving roller 13 and the photosensitive drum 3*d*.

The sequential control is such that constant current source 70 is on only when the recording material short-circuits between the fourth photosensitive drum 3*d* and the driving roller 13 or when the recording material short-circuits between the third photosensitive drum 3*c* and the driving roller 13, and otherwise it is off even during the image formation.

By doing so, the current through the driving roller 13 is controlled to be not more than a predetermined value level. In this embodiment, the current through the driving roller is controlled to be 0 $\mu$A, so that transferring current is prevented from escaping to the main assembly ground through the driving roller and so that current is prevented from flowing into the driving roller 13 when the recording material p is electrically discharged by the separation charger 32, by which the above-described image defects attributable to the transfer defect can be avoided.

In view of separation discharge which may occur at the separation portion in low humidity condition, the voltage source 70 is on-off-controlled by CPU74 as control means in accordance with the ambience humidity in this embodiment. More particularly, in the low humidity ambience, the separation charger 32 is on, and the constant current source 70 is off; in the high humidity ambience, the separation charger 32 is off and the constant current source 70 is on.

The separation charger 32 is disposed above the most downstream portion of the transfer belt 130, namely, above the driving roller 13 of the transfer belt 130, and is provided with a discharge wire. The discharge wire is stretched in the thrust direction, and the tension thereof is kept by the provision of the spring at one end of the discharge wire. The electric energy supply to the discharge wire is effected through a connector provided in the main assembly and through an unshown electric energy supply contact, an electric energy supply pin and a spring.

The driving roller 13 is connected to the main assembly ground through the constant current source 70, and functions also as an opposite electrode for the discharge wire.

In this embodiment, the distance between the transfer charger 24*d* and the separation charge portion(the position where the recording material p is separated from the transfer belt 130) d2=50 mm, and the separation charger 32 is supplied with an AC voltage having 10 kVpp, 500 Hz.

As described hereinbefore, under the low humidity ambience, the electrostatic attraction force between the recording material and the transfer belt 130 is larger, and therefore, the effect of weakening the electrostatic attraction force by the separation charger 32 is significant. Under the low humidity ambience, the image defect attributable to the separation charge tends to occur upon separation between the transfer belt 130 and the recording material, and therefore, the separation charger 32 is effective as a countermeasure there against. The transfer defect does not easily occur under the low humidity ambience, and therefore, the zero Ampare control(constant current control) for the driving roller 13 is closed in Embodiment 1 is not necessary. So, it is preferable to render on the separation charger 32 upon separation, and the constant-current-control is off (non-operated), under the low humidity ambience.

On the other hand, under the high humidity ambience, the electrostatic attraction force between the transfer belt 130 and the recording material is small as compared with the case of the low humidity ambience, and therefore, the effect of the separation charger 32 is relatively small. However, the transfer defect tends to occur, and therefore, the constant-current-control for the driving roller 13 is preferably carried out. Accordingly, under the high humidity ambience, the separation charger is off, and the constant-current-control is on.

In this embodiment, on-off of the separation charger 32 and the constant-current-control is carried out in accordance with the humidity ambience(absolute water content) as follows:

TABLE 1

| | Water Content | Separation Charger | Constant Current Control |
|---|---|---|---|
| Ambience A | no less than 10 g/kg | on | off |
| Ambience B | no more than 10 g/kg | on | off |

The volume resistivity of the recording material p under the ambiences A and B are approx. $10^7$ and $10^{11}$ Ohm·cm, respectively, and the currents into the driving roller 13 is approx. 3 $\mu$A and 0 $\mu$A respectively.

In this embodiment, the current including the current which may occur by the separation charger 32 as the current generating source, is prevented from flowing.

By doing so, an image forming apparatus is provided wherein the separation property between the transfer belt 130 and the recording material p and the image quality are maintained high even under the low humidity ambience, and the transfer defect is prevented from occurring even under the high humidity ambience.

The ambience temperature/humidity is detected automatically by a temperature/humidity detection sensor provided in the main assembly of the image forming apparatus.

Embodiment 2

The second embodiment of the present invention will be described. In this embodiment, the on-off of the separation charger 32 and the constant-current-control is controlled in accordance with the types of the recording material p by a CPU74 as the control means.

The basis weight of the recording material used with the image forming apparatus ranges between approx. 50 g/m$^2$–200 g/m$^2$, and the resistance of the recording materials are different.

The recording material having a large basis weight has a relatively large thickness, and therefore, the resistance between its front side and the back side is large. Therefore, a high transfer voltage is required, and the transferring current tends to escape more to the driving roller 13. The larger thickness of the recording material means larger cross-sectional area through which the current flows, and results in the tendency of the transferring current escaping to the driving roller 13. Accordingly, an image forming apparatus is provided wherein when an image is formed on a recording material having a large thickness, the zero Ampare control(constant current control) between the transfer charge portion and the driving roller is carried out so that escape of the transferring current is prevented, and therefore, the transfer defect does not occur.

The type of the recording material is automatically discriminated by a mechanical sensor or an optical sensor, but an operator may set on a control panel.

Embodiment 1 and Embodiment 2 may be properly combinated to control on-off switchings of the separation charger 32 and the constant current source 70 in accordance with the detection results of the humidity(absolute water content) and the type of the recording material p.

Embodiment 3

Figure 3:
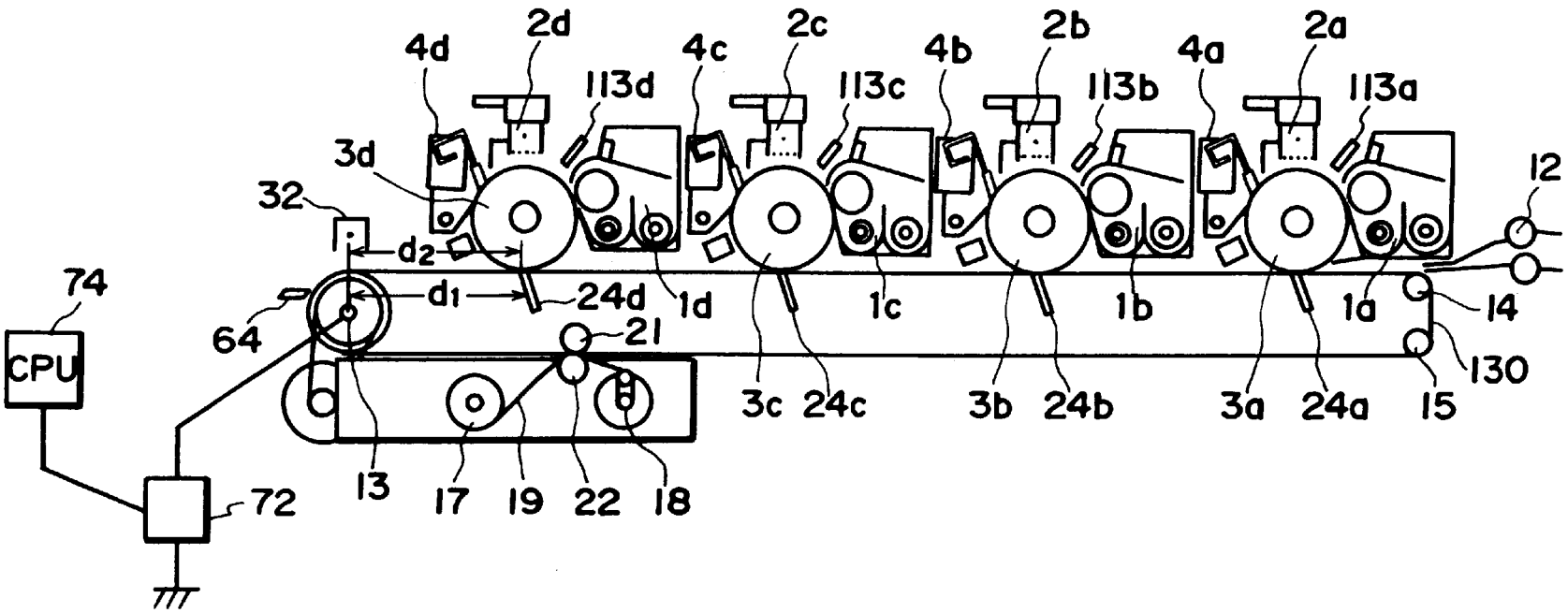
FIG. 3 is a schematic view of an image forming apparatus of Embodiments 3 and four.

In this embodiment, as shown in FIG. 3, the driving roller 13 is supplied with a predetermined positive voltage(the voltage of the same polarity as the polarity of the voltage applied to the transfer charger 24*a*–24*d* or the voltage of the opposite polarity from the polarity of the toner image on the photosensitive drum) by a voltage source 72, so that potential of the driving roller 13 per se is made high, thus preventing the flow of the negative charge to the transfer portion. As a result, the negative charge does not flow to the transfer portion, and a remarkable transfer defect and image defect can be prevented. In this embodiment, the voltage source 72 is a constant voltage source.

In view of separation discharge which may occur in the separation portion under a low humidity condition, the positive voltage bias applied to the driving roller 13 by the voltage source 72 (the voltage of the same polarity as the polarity of the voltage applied to the transfer charger 24*a*–24*d*) is changed by a CPU74 as a control means in accordance with the ambience humidity in this embodiment.

The volume resistivities of the recording material p sufficiently kept under a low humidity ambience and the recording material p sufficiently kept under the high humidity ambience are different by about 4 digits. Therefore, it is considered that amount of flow of the negative charge varies significantly depending on the ambience. In this embodiment, the applied voltage is low under the low humidity ambience, and it is high under the high humidity ambience so that flow amount of the negative charge to the transfer portion is controlled.

Under the low humidity ambience, the volume resistivity of the recording material p is high as compared with the case of high humidity ambience(for example, $10^{12}$ Ohm·cm or higher), and therefore, the amount of the flow of the negative charge to the transfer portion is low. Therefore, it is preferable that positive voltage applied to the driving roller 13 from the voltage source 72 is small.

On the other hand, under the high humidity ambience, the volume resistivity of the recording material p is low (for example, $10^{10}$ Ohm·cm or lower), and therefore, the amount of flow of the negative charge to the transfer portion is large. Therefore, it is preferable that positive voltage applied to the driving roller 13 is high.

In this embodiment, the applied voltage is controlled in accordance with the humidity(absolute water content) as follows:

Ambience C (Absolute Water Content is not less than 20 g/kg): 7 kV

Ambience D (Absolute Water Content is not less than 1.5 g/kg and less than 20 g/kg): 4 kV Ambience E: (Absolute Water Content is less than 1.5 g/kg): 1 kV Under the ambiences C, D and E, the volume resistivity of the recording material p are approx. $10^{10}$, $10^{11}$ and $10^{15}$ Ohm·cm.

With the above-described structure, an image forming apparatus is provided which is not influenced by the ambience, and the transfer defect does not occur.

The ambience temperature/humidity may be detected automatically by a temperature/humidity detection sensor provided in the main assembly of the image forming apparatus, or the operator or a serviceman may set on a control panel.

Embodiment 4

In this embodiment, the positive voltage bias applied to the driving roller 13 (the voltage of the same polarity as the voltage applied to the transfer charger 24*a*–24*d*) is changed by a CPU74 as a control means in accordance with types of the recording material.

The basis weight of the recording material used with the image forming apparatus widely ranges 50 g/m$^2$–200 g/m$^2$, and therefore, the resistances of the recording materials p widely different, and the amount of the negative charge flowing to the transfer portion during the image formation is influenced by the property of the recording material p.

A recording material p having a large basis weight has a large thickness, and therefore, the resistance between the front side and the back side thereof is large with the result of large amount of the negative charge flowing to the transfer portion and therefore the tendency of occurrence of said transfer defect. On the other hand, the recording material p having a small basis weight, has a small thickness, and the results are the opposite. Therefore, when the image formation is carried out on a recording material having a large thickness, the positive voltage applied to the driving roller 13 is made high by which the amount of the negative charge to the transfer portion is decreased, thus preventing the transfer defect.

The types of the recording material may be automatically detected by a mechanical or optical sensor, or an operator may set the type of the recording material on a control panel.

Embodiment 5

Figure 2:
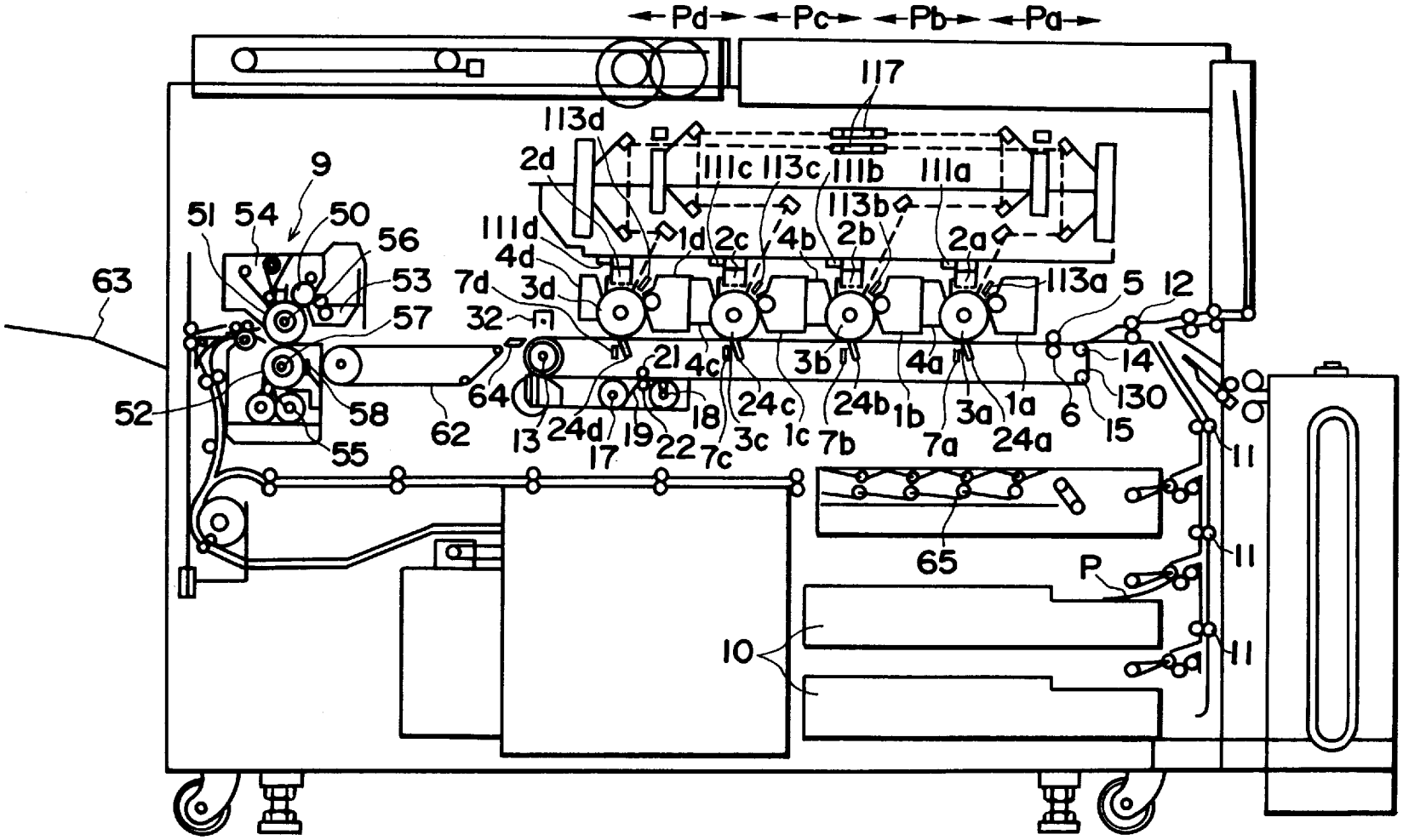
FIG. 2 is a schematic view of an image forming apparatus of Embodiments 3 to 7.

The inventors used the apparatus shown in FIG. 2, and carried out image formations under a high temperature and high humidity ambience(room temperature of 30° C. and relative humidity of 8%), during which the resistance between the photosensitive drum 3*d* and the transfer charger 24*d* was measured; and it was 100M Ohm. At this time, between the transfer charger 24*d* and the photosensitive drum 3*d*, a transfer belt 130 and the recording material p were interposed, the recording material p being paper having a basis weight of 157 g/m$^2$ (print paper Ginkan 157 g/m$^2$, available from Nippon Seishi KABUSHIKI KAISHA). Simultaneously with the measurement, the resistance between the transfer charger 24*d* and the grounding portion of the driving roller 13 as the opposite electrode for the separation charger 32 was determined, and it was 10M Ohm.

It was determined by applying a predetermined transfer voltage to the transfer charger 24*d* and measuring the current flowing through the photosensitive drum 3*d* and the driving roller 13.

Figure 4:
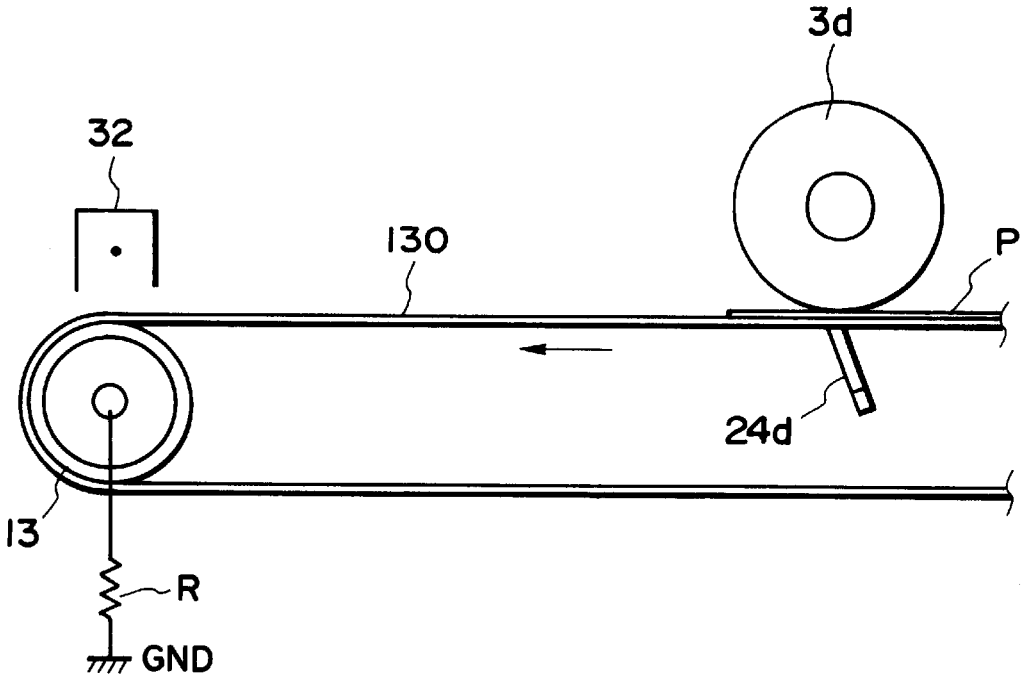
FIG. 4 is a schematic view of an image forming apparatus of Embodiments 5 to 7.

Accordingly, in this embodiment, the driving roller 13 is not directly connected to the main assembly ground GND, but as shown in FIG. 4, the driving roller 13 is connected to the main assembly ground GND through the resistor R of 1000M Ohm, and the resistance between the transfer charger 24*d* and the grounding portion of the driving roller 13 is increased from 10M Ohm to 10+1000=1010M Ohm, that is, the resistance sufficiently higher than the resistance 100M Ohm between the photosensitive drum 3*d* and the transfer charger 24*d*.

Therefore, in this embodiment, the transferring current by the transfer charger 24*d* does not escape to the main assembly ground GND through the driving roller 13, and therefore, sufficient transferring current is supplied to the photosensitive drum 3*d*, and the toner image is properly transferred onto the transfer material P from the photosensitive drum 3*d*, thus providing a high quality image without transfer defect. Furthermore, the occurrence of the transfer defect when the recording material is discharged by the separation charger 32 upon separation, can be prevented.

Figure 6:
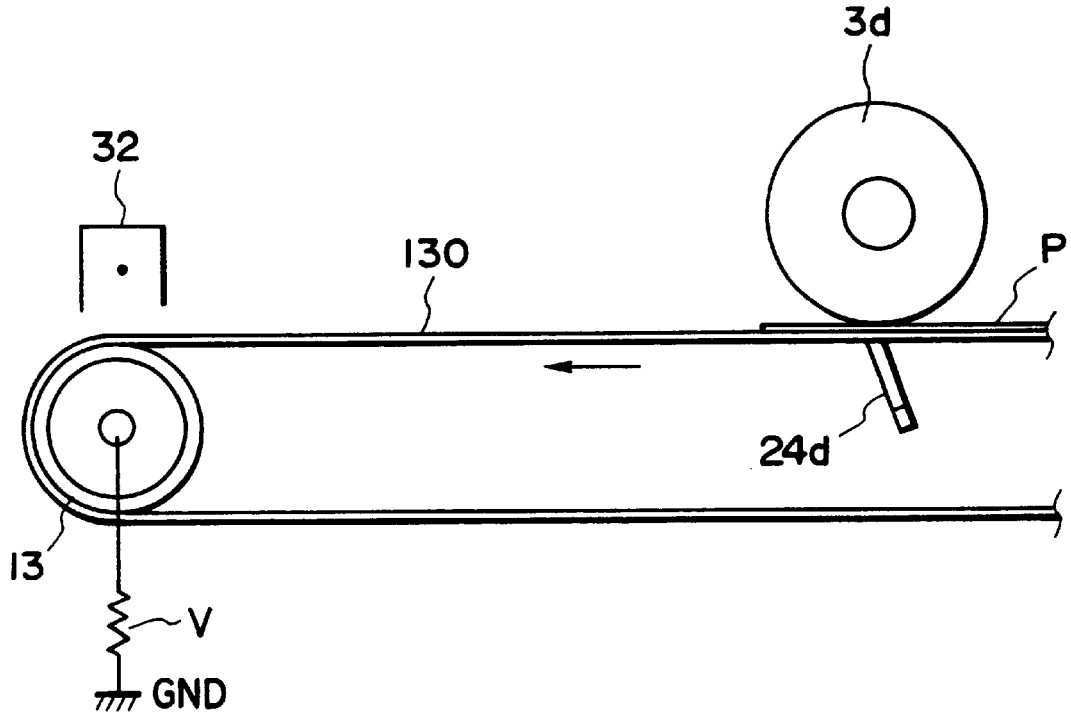
FIG. 6 is a schematic view of the image forming apparatus of FIG. 4, where a varister is used in place of a resistor.

In the foregoing, in order to prevent escape of the transferring current to the main assembly ground GND through the driving roller 13, a resistor R is connected between the driving roller 13 and the main assembly ground GND to increase the resistance(impedance) between the driving roller 13 and the main assembly ground GND, but, as illustrated in FIG. 6 a varister V may be used in place of the resistor R.

Alternatively, a high resistance member may be provided on the surface of the driving roller 13 to increase the resistance between the driving roller 13 and the transfer charger 24*d* so that transferring current is prevented from escaping to the main assembly ground GND through the driving roller 13.

Embodiment 6

This embodiment is similar to Embodiment 5 shown in FIG. 4, but a resistor R provided between the driving roller 13 and the main assembly ground GND is in the form of a variable resistor, and the resistance is changed by a CPU74 as a control means in accordance with the ambience humidity.

As described in the foregoing, under a low humidity ambience, the electrostatic attraction force between the transfer belt 130 and the recording material is large as compared with the case of high humidity ambience, and therefore, the effect of weakening the electrostatic attraction force by the separation charger 32 is significant. However, the transfer defect which is a problem does not easily occur under the low humidity ambience, and therefore, it is not necessary to increase the resistance between the driving roller 13 and the main assembly ground GND at the cost of deteriorating the separation property for the recording material. Thus, under the low humidity ambience, it is desirable to lower the resistance of the variable resistor R to enhance the function of the driving roller 13 functioning as the opposite electrode for the separation charger 32.

On the other hand, under the high humidity ambience, the electrostatic attraction force between the transfer belt 130 and the recording material is small as compared with the case of low humidity ambience, and therefore, the electrostatic attraction force reducing effect due to the separation charger 32 is not so significant. In addition, the transfer defect tends to occur, and therefore, the resistance between the driving roller 13 and the main assembly ground GND is high. Accordingly, under the high humidity ambience, the resistance of the variable resistor R is preferably large.

In this embodiment, under the low humidity ambience the variable resistor R provides a low resistance, and under the high humidity ambience it provides a high resistance. Examples of the resistance of the variable resistor R in this embodiment are given below:

Ambience F (Absolute water content is no less than 15 g/kg): 1000M Ohm

Ambience G (Absolute water content is 5–15 g/kg): 100M Ohm

Ambience H (Absolute water content is less than f 5 g/kg): 0 Ohm

Under the ambiences F, G and H, the volume resistivities of the recording material are approx. $10^{10}$ Ohm·cm, $10^{11}$ Ohm·cm and $10^{15}$ Ohm·cm, and the measured resistances between the driving roller 13 and the transfer charger 24*d* are approx. 10M Ohm, 1000M Ohm and 1000M Ohm.

As described in the foregoing, in this embodiment, the resistance between the driving roller 13 and the main assembly ground GND is changed in accordance with the ambience humidity to maintain high separation property between the transfer belt 130 and the recording material under the low humidity ambience while maintaining high image quality under the high humidity ambience.

When the sufficient separation property is provided between the recording material and the transfer belt 130 under the high humidity ambience(the absolute water content is 15 g/kg or higher), the driving roller 13 may be isolated from the main assembly ground GND (float) in place of increasing the resistance between the driving roller 13 and the main assembly ground GND.

The temperature/humidity may be detected automatically by a temperature/humidity detection sensor provided in the main assembly of the image forming apparatus, and the resistance change may be made automatic in accordance with the detected humidity. Or, the temperature humidity may be detected by a temperature meter and a humidity meter, and the operator or a serviceman may manually input the temperature and the manually to change the resistance.

Embodiment 7

This embodiment is similar to Embodiment 5 or 6 shown in FIG. 4, but the impedance between the driving roller 13 and the transfer charger 24*d* is controlled by the CPU74 as the control means in accordance with the types of the recording material p.

The basis weight of the recording material used with the image forming apparatus ranges approx. 50–200 g/m$^2$. The resistance of the recording material significantly changes in accordance with the basis weight. The recording material having a large basis weight has a large thickness, and therefore, the resistance between the front side and the back side is large. Therefore, the required transfer voltage is large, and the transferring current further tends to escape to the driving roller 13 through the recording material p.

When the image formation is effected on a recording material having a large thickness, the resistance between the driving roller 13 and the transfer charger 24*d* is increased to prevent the escape of the transferring current. By doing so, high quality images without transfer defect can be provided.

The types of the recording material can be automatically detected by a mechanical or optical sensor, but may be manually set on a control panel.

In the foregoing Embodiments 1–7, the transfer charger may be a corona charger, an electroconductive elastic roller, a brush or the like, and the same advantageous effects can be provided.

The image bearing member is not limited to an electrophotographic photosensitive member, but may be a dielectric member in an electrostatic recording.

The developing means 1*a*–1*d* for developing the electrostatic latent images on the image bearing members 3*a*–3*d*, will be briefly described. Generally, in the case of non-magnetic toner, it is applied on the sleeve using a blade or the like, and in the case of magnetic toner, it is applied on the sleeve using magnetic force. The toner is carried on the sleeve to a developing zone. There are an one-component non-contact development method wherein the sleeve is not contacted to the image bearing member, a one-component contact developing method wherein the sleeve is contacted to the image bearing member. In other types, the use is made with a developer containing toner particles and magnetic carrier particles mixed therewith, and the developer is carried by magnetic force. There are a two-component contact developing method wherein the developer is contacted to the image bearing member, and a two component non-contact development method wherein the developer is not contacted to the image bearing member. Such four types of the development is generally used. In this embodiment, two-component contact type developing system is used from the standpoint of the high quality and high stability of the image. However, the present invention is usable with any other types of development.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for carrying a toner image;

a recording material conveyer belt for electrostatically carrying and feeding a recording material such that the recording material is contacted to said image bearing member;

a roller for supporting said recording material conveyer belt, said roller being disposed at a position where the recording material is separated from said recording material conveyer belt and which is opposite from such a side of said recording material conveyer belt that carries the recording material;

transfer charging means for electrostatically transferring the toner image from said image bearing member onto the recording material carried on said recording material conveyer belt at a transfer position;

discharging means for electrically discharging the recording material when the recording material is separated from said recording material conveyer belt, said discharging means being disposed opposed to said roller with said recording material conveyer belt therebetween, wherein an electric discharging operation of said discharging means is started while the toner image is being transferred by said transfer means;

wherein said roller is electrically grounded through a varister.

2. An apparatus according to claim 1, wherein said roller comprises an electroconductive member.

3. An apparatus according to claim 1, wherein said discharging means is a corona charger.

4. An apparatus according to claim 1, wherein when the toner image is transferred from said image bearing member onto the recording material carried on said recording material conveyer belt, said transfer charging means is contacted to a side of said recording material conveyer belt opposite from such a side that carries the recording material.

5. An apparatus according to claim 1, wherein said recording material conveyer belt comprises a dielectric member.

6. An apparatus according to claim 1, wherein a plurality of such image bearing members are provided to carry toner images of different colors, and the toner images are sequentially transferred onto the recording material carried on said recording material conveyer belt.

7. An apparatus according to claim 6, wherein a plurality of such transfer charging means are provided to effect the sequential image transfer.

8. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material is separated from said recording material conveyer belt and which is opposite from such a side of said recording material conveyer belt that carries the recording material;

transfer charging means for electrostatically transferring the toner image from said image bearing member onto the recording material carried on said recording material conveyer belt;

discharging means for electrically discharging the recording material when the recording material is separated from said recoding material conveyer belt, said discharging means being disposed opposed to said roller with said recording material conveyer belt therebetween;

voltage applying means for applying a voltage to said roller;

detecting means for detecting a temperature and a humidity; and control means for selectively effecting, in accordance with an absolute water content corresponding to the temperature and the humidity detected by said detecting means, a control of a current to said roller from said voltage applying means to be a predetermined value upon separation of the recording material from said recording material conveyer belt.

9. An apparatus according to claim 8, further comprising recording material detecting means for detecting a type of the recording material, and said control means selectively effects the control in accordance with a detection result of said recording material detecting means.

10. An apparatus according to claim 9, wherein said recording material detecting means detects a thickness of the recording material.

11. An apparatus according to claim 8, wherein said control means selectively effects the discharging means in accordance with the absolute water content.

12. An apparatus according to claim 8 or 9, wherein said predetermined value is substantially zero.

13. An apparatus according to claim 8, wherein said roller comprises an electroconductive member.

14. An apparatus according to claim 8, wherein said discharging means includes a corona charger.

15. An apparatus according to claim 8, wherein when the toner image is transferred from said image bearing member onto the recording material carried on said recording material conveyer belt, said transfer charging means is contacted to a side of said recording material conveyer belt opposite from such a side that carries the recording material.

16. An apparatus according to claim 8, wherein said recording material conveyer belt comprises a dielectric member.

17. An apparatus according to claim 8, wherein a length of the recording material measured in a recording material feeding direction of said recording material conveyer belt is larger than a distance between a position where the toner image is transferred from said image bearing member onto the recording material carried on said recording material conveyer belt and a position where the recording material is separated from said recording material conveyer belt.

18. An apparatus according to claim 8, wherein a plurality of such image bearing members are provided to carry toner images of different colors, and the toner images are sequentially transferred onto the recording material carried on said recording material conveyer belt.

19. An apparatus according to claim 18, wherein a plurality of such transfer charging means are provided to effect the sequential image transfer.

20. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material is separated from said recording material conveyer belt and which is opposite from such a side of said recording material conveyer belt that carries the recording material;

transfer discharging means for electrostatically transferring the toner image from said image bearing member onto the recording material carried on said recording material conveyer belt;

discharging means for electrically discharging the recording material when the recording material is separated from said recording material conveyer belt, said discharging means being disposed opposed to said roller with said recording material conveyer belt therebetween;

voltage application means for applying to said roller a voltage of a polarity opposite from a regular polarity of the toner image on said image bearing member;

detecting means for detecting a temperature and a humidity; and control means for controlling the voltage in accordance with an absolute water content corresponding to the temperature and the humidity detected by said detecting means upon separation of the recording material from said recording material conveyer belt.

21. An apparatus according to claim 20, further comprising recording material detecting means for detecting a type of the recording material, wherein said control means changes the voltage in accordance with an output of said recording material detecting means.

22. An apparatus according to claim 21, wherein said recording material detection means detects a thickness of the recording material.

23. An apparatus according to claim 20, wherein said control means controls said voltage so that current to said roller is substantially zero when the absolute water content is higher than a predetermined level.

24. An apparatus according to claim 20, wherein said roller comprises an electroconductive member.

25. An apparatus according to claim 20, wherein said discharging means is a corona charger.

26. An apparatus according to claim 20, wherein when the toner image is transferred from said image bearing member onto the recording material carried on said recording material conveyer belt, said transfer discharging means is contacted to a side of said recording material conveyer belt opposite from such a side that carries the recording material.

27. An apparatus according to claim 20, wherein said recording material conveyer belt comprises a dielectric member.

28. An apparatus according to claim 20, wherein a length of the recording material measured in a recording material feeding direction of said recording material conveyer belt is larger than a distance between a position where the toner image is transferred from said image bearing member onto the recording material carried on said recording material conveyer belt and a position where the recording material is separated from said recording material conveyer belt.

29. An apparatus according to claim 20, wherein a plurality of such image bearing members are provided to carry toner images of different colors, and the toner images are sequentially transferred onto the recording material carried on said recording material conveyer belt.

30. An apparatus according to claim 29, wherein a plurality of such transfer discharging means are provided to effect the sequential image transfer.

31. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material is separated from said recording material conveyer belt and which is opposite from such a side of said recording material conveyer belt that carries the recording material;

transfer charging means for electrostatically transferring the toner image from said image bearing member onto the recording material carried on said recording material conveyer belt;

discharging means for electrically discharging the recording material when the recording material is separated from said recording material conveyer belt, said discharging means being disposed opposed to said roller with said recording material conveyer belt therebetween;

voltage applying means for applying a voltage to said roller;

detecting means for detecting a temperature and a humidity;

wherein a current supplied from said voltage applying means to said roller is larger when an absolute water content corresponding to the temperature and the humidity detected by said detecting means is equal to or higher than a predetermined level than when the absolute water content is lower than the predetermined level.

32. An apparatus according to claim 31 wherein when the absolute water content is not less than the predetermined level, the roller is electrically floated.

33. An apparatus according to claim 31 or 32, wherein when the absolute water content is less than the predetermined level, said roller is electrically grounded.

34. An apparatus according to claim 31, wherein said roller comprises an electroconductive member.

35. An apparatus according to claim 31, wherein said discharging means includes a corona charger.

36. An apparatus according to claim 31, wherein when the toner image is transferred from said image bearing member onto the recording material carried on said recording material conveyer belt, said transfer charging means is contacted to a side of said recording material conveyer belt opposite from such a side that carries the recording material.

37. An apparatus according to claim 31, wherein said recording material conveyer belt comprises a dielectric member.

38. An apparatus according to claim 31, wherein a length of the recording material measured in a recording material feeding direction of said recording material conveyer belt is larger than a distance between a position where the toner image is transferred from said image bearing member onto the recording material carried on said recording material conveyer belt and a position where the recording material is separated from said recording material conveyer belt.

39. An apparatus according to claim 31, wherein a plurality of such image bearing members are provided to carry toner images of different colors, and the toner images are sequentially transferred onto the recording material carried on said recording material conveyer belt.

40. An apparatus according to claim 39, wherein a plurality of such transfer charging means are provided to effect the sequential image transfer.

41. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material is separated from said recording material conveyer belt and which is opposite from such a side of said recording material conveyer belt that carries the recording material;

transfer charging means for electrostatically transferring the toner image from said image bearing member onto the recording material carried on said recording material conveyer belt;

discharging means for electrically discharging the recording material when the recording material is separated from said recording material conveyer belt, said discharging means being disposed opposed to said roller with said recording material conveyer belt therebetween;

wherein said roller is electrically grounded through a resistance element; and control means for controlling a resistance value of said resistance element.

42. An apparatus according to claim 41, wherein a length of the recording material measured in a recording material feeding direction of said recording material conveyer belt is larger than a distance between a position where the toner image is transferred from said image bearing member onto the recording material carried on said recording material conveyer belt and a position where the recording material is separated from said recording material conveyer belt.

43. An apparatus according to claim 41 or 42, further comprising detecting means for detecting a temperature and a humidity, wherein said control means controls the resistance value on the basis of an output of said detecting means.

44. An apparatus according to claim 43, wherein said control means controls the resistance value on the basis of an absolute water content corresponding to the temperature and the humidity detected by said detecting means.

45. An apparatus according to claim 43, further comprising recording material detecting means for detecting a type of the recording material, wherein said control means controls the resistance value on the basis of detected output of said recording material detecting means.

46. An apparatus according to claim 45, wherein said recording material detecting means detects a thickness of the recording material.

47. An apparatus according to claim 41 or 42, further comprising recording material detecting means for detecting a type of the recording material, wherein said control means controls the resistance value on the basis of detected output of said recording material detecting means.

48. An apparatus according to claim 47, wherein said recording material detecting means detects a thickness of the recording material.

49. An apparatus according to claim 41 or 42, wherein said roller comprises an electroconductive member.

50. An apparatus according to claim 41 or 42, wherein said discharging means is a corona charger.

51. An apparatus according to claim 41 or 42, wherein when the toner image is transferred from said image bearing member onto the recording material carried on said recording material conveyer belt, said transfer charging means is contacted to a side of said recording material conveyer belt opposite from such a side that carries the recording material.

52. An apparatus according to claim 41 or 42, wherein said recording material conveyor belt comprises a dielectric member.

53. An apparatus according to claim 41 or 42, wherein a plurality of such image bearing members are provided to carry toner images of different colors, and the toner images are sequentially transferred onto the recording material carried on said recording material conveyer belt.

54. An apparatus according to claim 53, wherein a plurality of such transfer charging means are provided to effect the sequential image transfer.

55. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material separated from said recording material conveyer belt and which is opposite from such a side of said recording material conveyer belt that carries the recording material;

transfer charging means for electrostatically transferring the toner image from said image bearing member onto the recording material carried on said recording material conveyer belt;

voltage applying means for applying a voltage to said roller; and determining means for determining a voltage applied to said roller from said voltage applying means on the basis of information on a temperature and a humidity.

56. An apparatus according to claim 55, wherein a length of the recording material measured in a recording material feeding direction of said recording material conveyer belt is larger than a distance between a position where the toner image is transferred from said image bearing member onto the recording material carried on said recording material conveyer belt and a position where the recording material is separated from said recording material conveyer belt.

57. An apparatus according to claim 55 or 56, further comprising detecting means for detecting a temperature and a humidity, wherein control means controls the voltage on the basis of information on the temperature and the humidity detected by said detecting means.

58. An apparatus according to claim 57, wherein said determining means determines the voltage on the basis of information on an absolute water content corresponding to the temperature and the humidity detected by said detecting means.

59. An apparatus according to claim 58, wherein when the absolute water content is at least a predetermined level, said determining means controls the voltage such that an electric current flowing through said roller is substantially zero.

60. An apparatus according to claim 59, wherein when the absolute water content is less than the predetermined level, said roller is electrically grounded.

61. An apparatus according to claim 57, further comprising recording material detecting means for detecting a type of the recording material, wherein said determining means determines the voltage on the basis of the type of the recording material detected by said recording material detecting means.

62. An apparatus according to claim 61, wherein said recording material detecting means detects a thickness of the recording material.

63. An apparatus according to claim 55 or 56, further comprising recording material detecting means for detecting a type of the recording material, wherein said determining means determines the voltage on the basis of the type of the recording material detected by said recording material detecting means.

64. An apparatus according to claim 63, wherein said recording material detecting means detects a thickness of the recording material.

65. An apparatus according to claim 55 or 56, wherein said determining means determines the voltage such that an electric current flowing through said roller is substantially zero.

66. An apparatus according to claim 55 or 56, further comprising discharging means for electrically discharging the recording material when the recording material is separated from said recording material conveyer belt, said discharging means being disposed opposed to said roller with said recording material conveyer belt therebetween.

67. An apparatus according to claim 55 or 56, wherein said determining means determines the voltage such that a current flowing through said roller is a predetermined current.

68. An apparatus according to claim 55 or 56, wherein the voltage has a polarity which is the same as that of a voltage applied to said transfer charging means during an image transfer operation.

69. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material is separated from said recording material conveyer belt and which is opposite from such a side of said recording material conveyer belt that carries the recording material;

transfer charging means for electrically transferring the toner image from said image bearing member onto the recording material carried on said recording material conveyer belt;

voltage applying means for applying a voltage to said roller; and determining means for determining a voltage applied to said roller from said voltage applying means on the basis of information on a type of the recording material.

70. An apparatus according to claim 69, wherein a length of the recording material measured in a recording material feeding direction of said recording material conveyer belt is larger than a distance between a position where the toner image is transferred from said image bearing member onto the recording material carried on said recording material conveyer belt and a position where the recording material is separated from said recording material conveyer belt.

71. An apparatus according to claim 69 or 70, further comprising recording material detecting means for detecting a type of the recording material, wherein said determining means determines the voltage on the basis of the type of the recording material detected by said recording material detecting means.

72. An apparatus according to claim 71, wherein said recording material detecting means detects a thickness of the recording material.

73. An apparatus according to claim 69 or 70, wherein said determining means determines the voltage such that an electric current flowing through said roller is substantially zero.

74. An apparatus according to claim 69 or 70, further comprising discharging means for electrically discharging the recording material when the recording material is separated from said recording material conveyer belt, said discharging means being disposed opposed to said roller with said recording material conveyer belt therebetween.

75. An image forming apparatus comprising:

an image bearing member for carrying a toner image;

a recording material conveyer belt for electrostatically carrying and feeding a recording material;

a roller for supporting said recording material conveyer belt, said roller being disposed at a position where the recording material is separated from said recording material conveyer belt and which is opposite from such a side of said recording material conveyer belt that carries the recording material;

transfer charging means for electrostatically transferring the toner image from said image bearing member onto the recording material carried on said recording material conveyer belt; and control means for controlling an electric current flowing through said roller.

76. An apparatus according to claim 75, wherein said control means controls the current on the basis of information on a temperature and a humidity.

77. An apparatus according to claim 75, further comprising detecting means for detecting a temperature and a humidity, wherein said control means controls the current on the basis of information on the temperature and the humidity detected by said detecting means.

78. An apparatus according to claim 77, wherein said control means determines the current on the basis of information on an absolute water content corresponding to the temperature and the humidity detected by said detecting means.

79. An apparatus according to claim 78, wherein when the absolute water content is not less than a predetermined level, said control means controls the current so as to be substantially zero.

80. An apparatus according to any one of claims 75–79, wherein said control means determines the current on the basis of a type of the recording material.

81. An apparatus according to any one of claims 75–79, wherein said control means determines the current on the basis of a thickness of the recording material.

82. An apparatus according to any one of claims 75–79, further comprising recording material detecting means for detecting a type of the recording material, wherein said control means determines the current on the basis of the type of the recording material detected by said recording material detecting means.

83. An apparatus according to claim 82, wherein said recording material detecting means detects a thickness of the recording material.

84. An apparatus according to claim 75, wherein said control means controls the current so as to be substantially zero.

85. An apparatus according to claim 75, in which said control means includes a constant current source for effecting a constant current control for said roller.

* * * * *

UNITED STATES PATENT AND TRADEMARK OFFICE

CERTIFICATE OF CORRECTION

PATENT NO. : 6,226,486 B1
DATED : May 1, 2001
INVENTOR(S) : Yoshikuni Itou et al.

It is certified that error appears in the above-identified patent and that said Letters Patent is hereby corrected as shown below:

Column 2,
Line 11, "portion" should read -- portion E --.
Line 44, "3 to 7." should read -- 1 to 7. --.
Line 46, "3 and four." should read -- 3 and 4. --.

Column 5,
Line 27, "polyvinylalccohol" should read -- polyvinylalcohol --.
Line 31, "polybarbonate," should read -- polycarbonate, --.
Line 60, "driving roller" should read -- driving roller 13 --.

Column 8,
Line 19, "combinated" should read -- combined --.

Column 9,
Line 55, "8%)," should read -- 80%), --.

Column 10,
Line 31, "FIG. 6" should read -- FIG. 6, --.

Column 12,
Line 14, "an" should read -- a --.
Line 26, "is" should read -- are --.

Column 13,
Line 33, "recoding" should read -- recording --.

UNITED STATES PATENT AND TRADEMARK OFFICE

CERTIFICATE OF CORRECTION

PATENT NO. : 6,226,486 B1
DATED : May 1, 2001
INVENTOR(S) : Yoshikuni Itou et al.

It is certified that error appears in the above-identified patent and that said Letters Patent is hereby corrected as shown below:

Column 17,
Line 28, "conveyor" should read -- conveyer --.

Signed and Sealed this

Twenty-sixth Day of March, 2002

*Attest:*

*Attesting Officer*

JAMES E. ROGAN
*Director of the United States Patent and Trademark Office*